US008899196B2

(12) United States Patent
Choi et al.

(10) Patent No.: US 8,899,196 B2
(45) Date of Patent: Dec. 2, 2014

(54) VARIABLE VALVE LIFT APPARATUS

(71) Applicant: Hyundai Motor Company, Seoul (KR)

(72) Inventors: Byong Young Choi, Bucheon-si (KR); Chung Han Oh, Seongnam-si (KR); Wootae Kim, Anyang-si (KR); Back Sik Kim, Osan-si (KR); Ingee Suh, Yongin (KR); Dae Sung Kim, Hwaseong-si (KR); Gang Il Kim, Hwaseong-si (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 14/055,512

(22) Filed: Oct. 16, 2013

(65) Prior Publication Data

US 2014/0182531 A1 Jul. 3, 2014

(30) Foreign Application Priority Data

Dec. 28, 2012 (KR) ..... 10-2012-0157499

(51) Int. Cl.
*F01L 1/34* (2006.01)

(52) U.S. Cl.
CPC ..... *F01L 1/34* (2013.01)
USPC ..... 123/90.16; 123/90.17

(58) Field of Classification Search
CPC ..... F01L 1/34
USPC ..... 123/90.15, 90.16, 90.17, 90.31
See application file for complete search history.

(56) References Cited

U.S. PATENT DOCUMENTS 7,409,938 B2 8/2008 Dengler
8,297,247 B2 * 10/2012 Schoeneberg et al. ..... 123/90.18

* cited by examiner

*Primary Examiner* — Zelalem Eshete
(74) *Attorney, Agent, or Firm* — Morgan, Lewis & Bockius LLP

(57) ABSTRACT

A variable valve lift apparatus may include a camshaft, a cam piece having first cams having lift amounts that are different formed at one side thereof, a first cam protrusion portion formed near the first cams that is slidably disposed on the camshaft to rotate with the camshaft, a first guide pin that protrudes on one side of an exterior circumference of the first cam protrusion portion, a first guide that is disposed to correspond to the first cam protrusion portion and in which a first guide groove is formed thereon to move the first cam piece in one direction along the camshaft according to the rotation of the first guide pin, and a first operation portion that moves the first guide toward the first cam protrusion portion such that the first guide pin is inserted into the first guide groove of the first guide.

9 Claims, 12 Drawing Sheets

High Lift

Middle Lift 1

Middle Lift 2

Low Lift

VARIABLE VALVE LIFT APPARATUS

CROSS-REFERENCE TO RELATED APPLICATION

The present application claims priority of Korean Patent Application Number 10-2012-0157499 filed Dec. 28, 2012, the entire contents of which application is incorporated herein for all purposes by this reference.

BACKGROUND OF INVENTION

1. Field of Invention

The present invention relates to a valve lift apparatus. More particularly, the present invention relates to a variable valve lift apparatus that varies a lift amount of a valve opening/closing an intake port or an exhaust port of an internal combustion engine in multi steps.

2. Description of Related Art

An internal combustion engine generates power by burning fuel in a combustion chamber in an air media that is drawn into the chamber. Intake valves are operated by a camshaft in order to intake the air, and the air is drawn into the combustion chamber while the intake valves are open.

In addition, exhaust valves are operated by the camshaft, and a combustion gas is exhausted from the combustion chamber while the exhaust valves are open.

An optimal operation of the intake valves and the exhaust valves depends on a rotation speed of the engine. That is, an optimal lift or optimal opening/closing timing of the valves depends on the rotation speed of the engine.

For example, research has been undertaken for a variable valve lift (VVL) apparatus that enables different lifts depending on engine speed, and for a variable valve timing (VVT) apparatus that opens/closes the valves with different timing depending on the engine speed.

Meanwhile, in a structure that a rocker arm is disposed on a rocker arm shaft and a cam pushes one side of the rocker arm to move a valve that is disposed at the other side of the rocker arm, researches have been undertaken so as to control the movement of the valve in multi steps.

The information disclosed in this Background section is only for enhancement of understanding of the general background of the invention and should not be taken as an acknowledgement or any form of suggestion that this information forms the prior art already known to a person skilled in the art.

BRIEF SUMMARY

Various aspects of the present invention provide for variable a valve lift apparatus having advantages of improving a drivability according to a load/rotation speed of an engine by varying a lift of a valve in multi-steps including a second step, a third step, and a fourth step.

A variable valve lift apparatus according to various aspects of the present invention may include a camshaft, a cam piece in which a first cams of which lift amounts are different are formed at one side thereof and a first cam protrusion portion is formed near the first cams and that is slidably disposed on the camshaft to rotate together with the camshaft, a first guide pin that protrudes on one side of an exterior circumference of the first cam protrusion portion, a first guide that is disposed to correspond to the first cam protrusion portion and in which a first guide groove is formed thereon to move the first cam piece in one direction along the camshaft according to the rotation of the first guide pin, and a first operation portion that moves the first guide toward the first cam protrusion portion such that the first guide pin is inserted into the first guide groove of the first guide.

The variable valve lift apparatus may further include a first return protrusion that protrudes on an outside surface of the first cam protrusion portion to push forward the first guide such that the first guide pin is separated from the first guide groove.

The first return protrusion may have a structure that becomes more distant from the camshaft in a rotating direction of the first cam protrusion portion.

The first return protrusion may be formed with a predetermined distance from the first guide pin in a rotating direction.

A second cams of which lift amount are different are formed on the cam piece with a distance from the first cams and a second cam protrusion portion is formed near the second cams, and may further include a second guide pin that protrudes on one side of an exterior circumference of the second cam protrusion portion, a second guide that is disposed to correspond to the second cam protrusion portion and in which a second guide groove is formed to guide the movement of the second guide pin such that the second cam piece is moved in the other side direction along the rotation of the camshaft according to the rotation of the second guide pin, a second operating portion that moves the second guide toward the second cam protrusion portion such that the second guide pin is inserted into the second guide groove of the second guide, and a second return protrusion that protrudes on an outside surface of the second cam protrusion portion to push forward the second guide such that the second guide pin is separated from the second guide groove.

The first cams may include a low cam, a first middle cam that is higher than the low cam, a second middle cam that is higher than the first middle cam, and a high cam that is higher than the second middle cam.

The variable valve lift apparatus may further include a rocker arm that is disposed on the rocker arm shaft so as to lift a valve through the first cam, wherein the rocker arm is disposed near the first member and the first member to press one side of a valve and includes a second member that is disposed to be moved by the first cam, and may further include a latching pin that is disposed in parallel with the rocker arm shaft, penetrates the first member and the second member and a wing that is inserted into a letching groove of the first cam piece protrudes on one end portion thereof to make the first member and the second member to move together or separate the first member from the second member.

An inner side width of the first guide groove may be longer than the exterior diameter of the first guide pin and a width of the return protrusion is longer than the inner side width of the first guide groove.

A variable valve lift apparatus may include a camshaft, a cam piece in which a first cams of which lift amounts are different are formed at one side thereof and a first cam protrusion portion protrudes in an outside direction near the first cams and that is slidably disposed on the camshaft to rotate together with the camshaft, a first guide bridge that protrudes on the first cam protrusion portion in a rotating direction of the camshaft and is slantly formed in a length direction of the camshaft, guide shafts that are disposed to correspond to the first cam protrusion portion, a gap that can be disposed between the guide bridge is formed between them, and moves the first cam piece in one side direction along the camshaft according to the rotation of the first guide bridge, and a first operating portion that moves the first guide toward the first cam protraction portion such that the first guide bridge is inserted into the gap of the guide shafts.

In a variable valve lift apparatus according to various aspects of the present invention, several cams are formed on a cam piece that is moved on a camshaft in a length direction and a valve lift can be controlled in multi-steps by moving the cam piece through an engagement structure of a guide pin and a guide.

Also, a return protrusion that is formed on the cam piece pushes out the guide to prevent the cam piece from being moved in a length direction.

Further, a rocker arm is divided into a first member and a second member, these are latched by a latching pin, the latching pin is moved together with the cam piece, and the latching pin can latch or divide the first member and the second member such that the rocker arm can flexibly vary a valve lift.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 1:
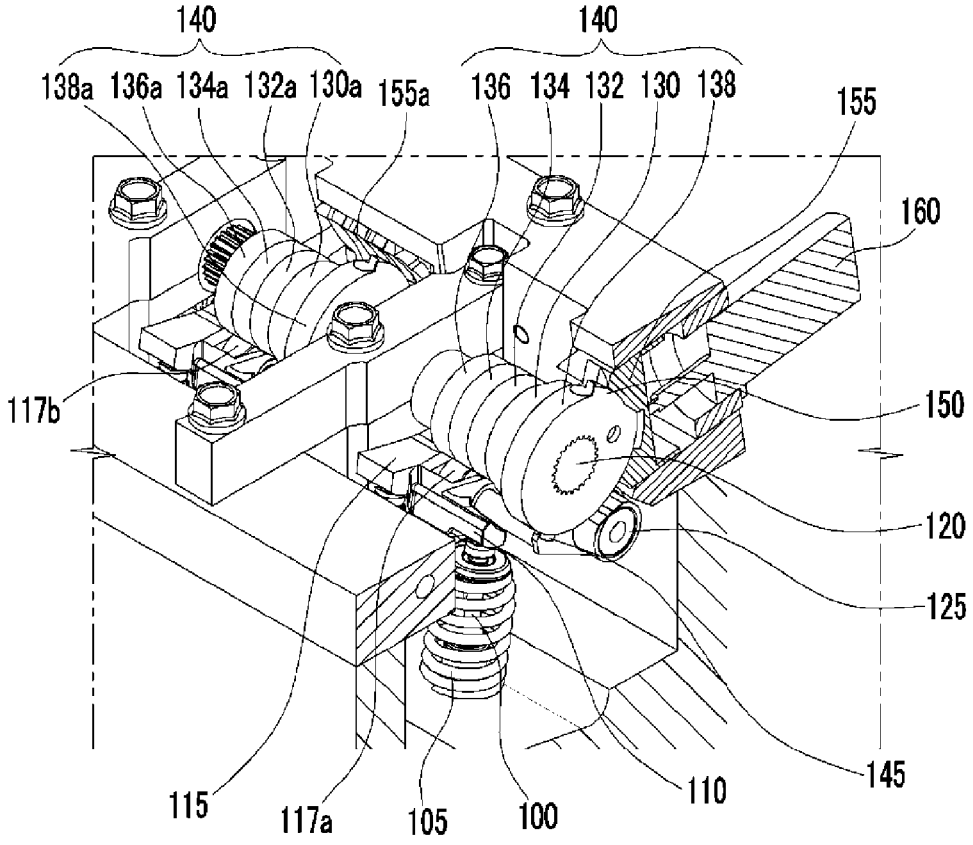
FIG. 1 is a partial sectional perspective view of an exemplary variable valve lift apparatus according to the present invention.

FIG. 1 is a partial sectional perspective view of a variable valve lift apparatus according to various embodiments of the present invention.

Referring to FIG. 1, a variable valve lift apparatus includes a valve 105, a valve spring 105, a rocker arm 115, a first and a second rollers 117*a* and 117*b*, a press portion 110, a cam piece or cam portion 140, a camshaft 120, a first guide 155, a second guide 155*a*, and a first operating portion 160.

First cams (136, 134, 132, and 130) and a first cam protrusion portion 138 near the first cams (136, 134, 132, 130) are formed on the cam piece 140. The first cams (136, 134, 132, and 130) include a low cam 136, a first middle cam 134, a second middle cam 132, and a high cam 130.

Second cams (136*a*, 134*a*, 132*a*, and 130*a*) corresponding to the first cams (136, 134, 132, 130) and a second cam protrusion portion near the second cams (136*a*, 134*a*, 132*a*, 130*a*) are formed on the cam piece 140. The second cams (136*a*, 134*a*, 132*a*, and 130*a*) include a low cam 136*a*, a first middle cam 134*a*, a second middle cam 132*a*, and a high cam 130*a*.

The first guide 155 is disposed near an exterior circumference of the first cam protrusion portion 138 to correspond to the first cam protrusion portion 138 and the first operating portion 160 pushes the first guide 155 toward the first cam protrusion portion 138.

The first guide 155 is disposed near the first cam protrusion portion 138, the second guide 155*a* is disposed to correspond to the second cam protrusion portion 138*a*, and the second operating portion is disposed to correspond to the second guide 155*a*.

A first guide pin 145 protrudes outwardly on an exterior circumference of the first cam protrusion portion 138, and a return protrusion 150 is formed on an opposite side of the first guide pin 145.

Figure 2:
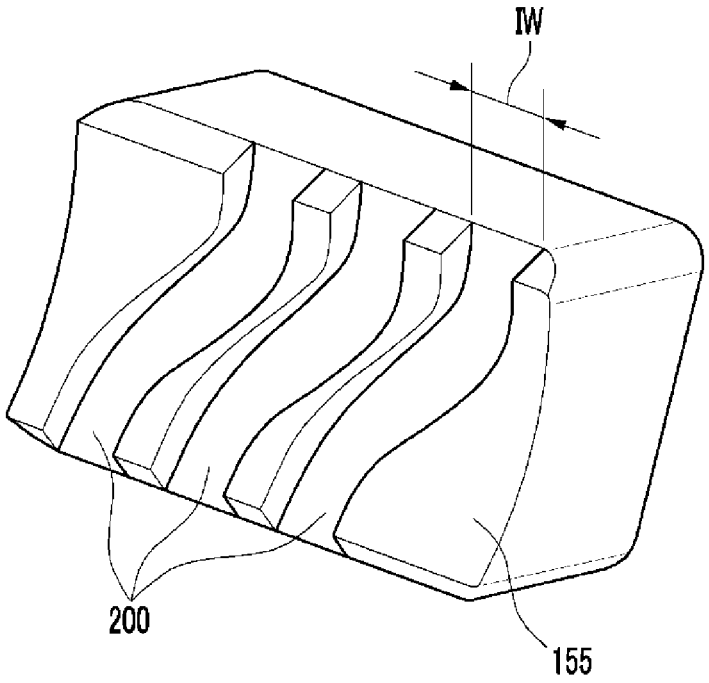
FIG. 2 is a perspective view of a first guide that is disposed on an exemplary variable valve lift apparatus according to the present invention.

FIG. 2 is a perspective view of a first guide that is disposed on a variable valve lift apparatus according to various embodiments of the present invention.

Referring to FIG. 1 and FIG. 2, first guide grooves 200 is formed on a surface that corresponds to the first cam protrusion portion 138 of the first guide 155. The number of the first guide grooves 200 can be set to correspond to the number of the first cams (136, 134, 132, and 130).

As shown in the drawings, the first guide groove 200 has an inner width (IW), and the inner width (IW) is shorter than the exterior diameter of the first guide pin 145. Accordingly, if the first operating portion 160 pushes the first guide 155 toward the first cam protrusion portion 138, the cam piece 140 and the first cam protrusion portion 138 rotate and the first guide pin 145 is inserted into the first guide groove 200 of the first guide 155.

And, when the first guide pin 145 moves along the first guide groove 200, the first guide groove 200 of the first guide 155 is formed along a curved line of a wave shape such that the cam piece 140 moves along a length direction of the camshaft 120.

Accordingly, when the camshaft 120 and the cam piece 140 rotates together, the first guide pin 145 of the first cam protrusion portion 138 moves along the first guide groove of the first guide 155. And, the cam piece 140 moves forward or backward in the length direction of the camshaft at a predetermined step.

The low cam 136, the first middle cam 134, the second middle cam 132, or the high cam 130 of the first cams (136, 134, 132, and 130) selectively pushes the first roller 117*a* of the rocker arm 115 such that the press portion 110 lifts the valve 100 in a low lift, in a first middle lift, in a second middle lift, or a high lift.

Also, the low cam 136*a*, the first middle cam 134*a*, the second middle cam 132*a*, and the high cam 130*a* of the second cams (136*a*, 134*a*, 132*a*, and 130*a*) selectively pushes the second roller 117*b* of the rocker arm such that the press portion lifts the valve 100 in a low lift, in a first middle lift, in a second middle lift, or a high lift.

In various embodiments of the present invention, the first guide 155 moves the cam piece 140 in one side through the first guide pin 145 of the first cam protrusion portion 138 and the second guide 155*a* and moves the cam piece 140 in the other side through a second guide pin of the second cam protrusion portion 138*a*.

Further, if the first operating portion 160 pushes the first guide 155 toward the first cam protrusion portion 138, the first guide pin 145 is guided along the first guide groove 200 of the first guide 155 to move the cam piece 140 in one side and the return protrusion 150 of the first cam protrusion portion 138 pushes the first guide 155 outwardly to keep the position of the cam piece 140.

The cam piece 140 is disposed to be moved back and forth along the camshaft 120 through a spline structure of the camshaft 120 and the camshaft 120 penetrates a central portion of the cam piece 140.

A ball groove is formed on an interior circumference that corresponds to an exterior circumference of the camshaft 120, a groove is formed on the camshaft 120 to correspond to the ball groove, a ball is disposed in the ball groove, and an elastic member like spring elastically supports the ball toward the ball groove. The structure of the ball and the spring is well-known to a person skilled in the art, the detailed description thereof will be omitted.

Accordingly, the cam piece 140 and the camshaft 120 is fixed on a predetermined position through a groove, a ball, and an elastic member, and they simultaneously moves in one side and the other side through the first guide 155 and the second guide 155*a*.

Figure 3:
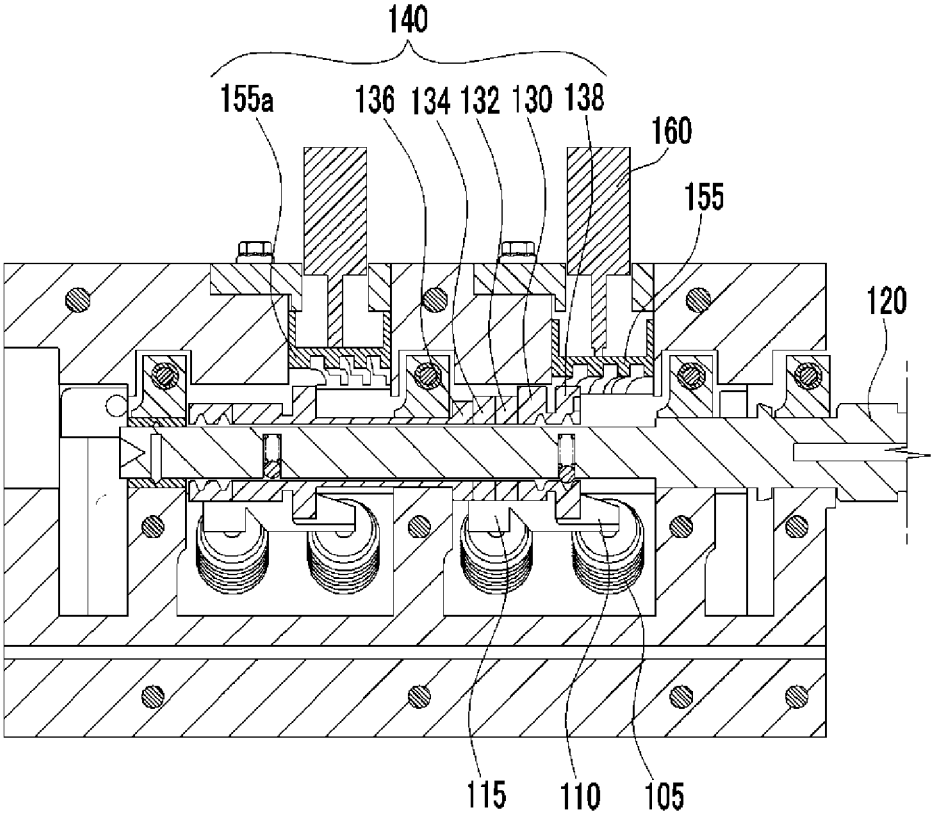
FIG. 3 is a partial sectional top plan view showing that an exemplary variable valve lift apparatus is being operated in a high lift condition according to the present invention.

FIG. 3 is a partial sectional top plan view showing that a variable valve lift apparatus is being operated in a high lift condition according to various embodiments of the present invention.

Referring to FIG. 3, the cam piece 140 that is disposed on the camshaft 120 is positioned at the extreme left, the first roller 117*a* of the rocker arm 115 operates the valve 100 to a high lift mode to correspond to the high cam 130 of the first cam (136, 134, 132, and 130).

And, if the first operating portion 160 is operated to push the first guide 155 toward the first cam protrusion portion 138, the first guide 155 moves the cam piece 140 to one step in a right side through the first guide pin 145.

Figure 4:
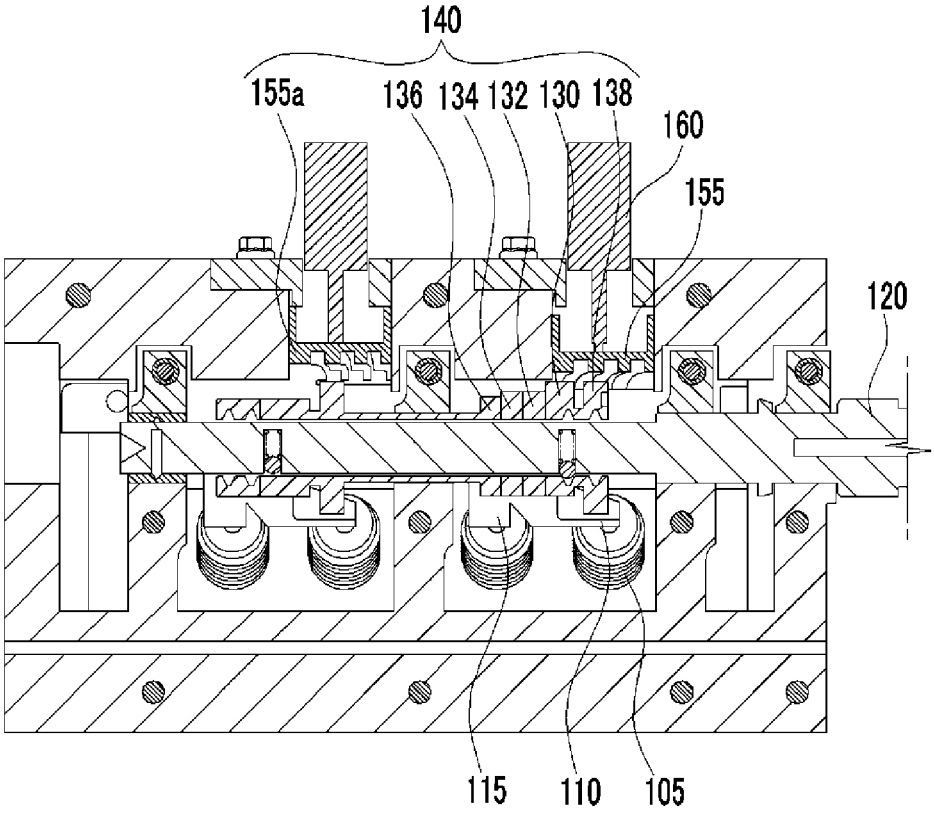
FIG. 4 is a partial sectional top plan view showing that an exemplary variable valve lift apparatus is being operated in a first middle lift condition according to the present invention.

FIG. 4 is a partial sectional top plan view showing that a variable valve lift apparatus is being operated in a first middle lift condition according to various embodiments of the present invention.

Referring to FIG. 4, the first roller 117*a* of the rocker arm 115 operates the valve 100 to a second middle lift mode to correspond to the second middle cam 132 of the first cam (136, 134, 132, and 130).

And, if the first operating portion 160 is operated again to move the first guide 155 toward the first cam protrusion portion 138, the first guide 155 moves the cam piece 140 to one step in a right side through the first guide pin 145.

Figure 5:
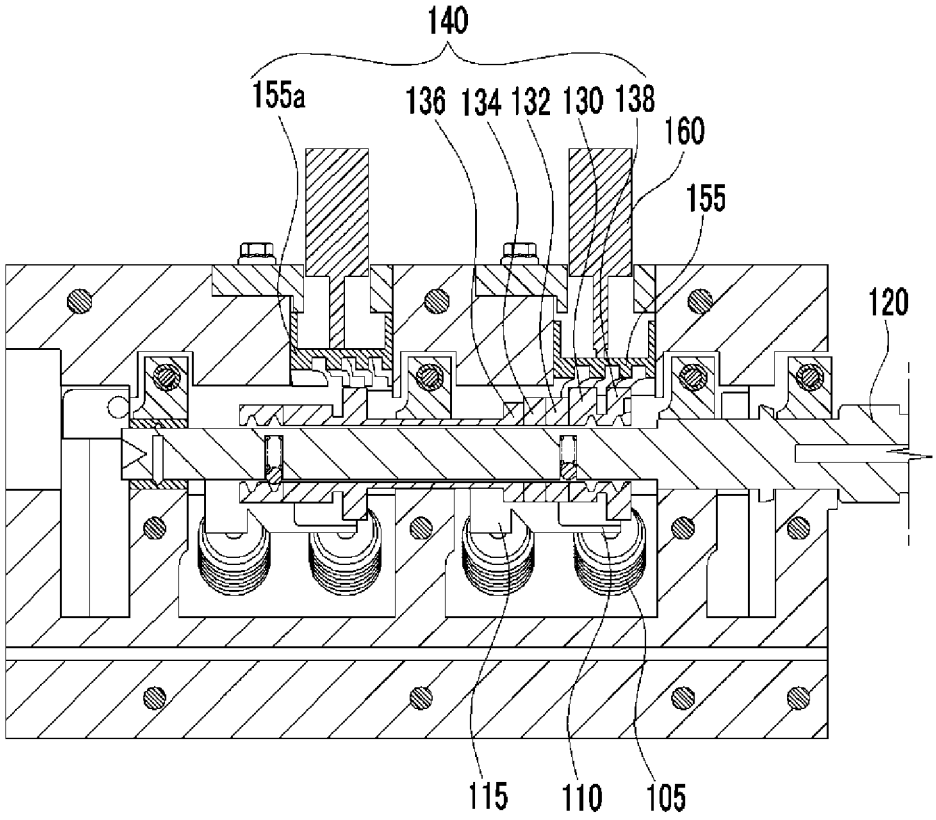
FIG. 5 is a partial sectional top plan view showing that an exemplary variable valve lift apparatus is being operated in a second middle lift condition according to the present invention.

FIG. 5 is a partial sectional top plan view showing that a variable valve lift apparatus is being operated in a second middle lift condition according to various embodiments of the present invention.

Referring to FIG. 5, the first roller 117*a* of the rocker arm 115 operates the valve 100 to a first middle lift mode to correspond to the first middle cam 134 of the first cam (136, 134, 132, 130).

And, if the first operating portion 160 is operated again to move the first guide 155 toward the first cam protrusion portion 138, the first guide 155 moves the cam piece 140 to one step in a right side through the first guide pin 145.

Figure 6:
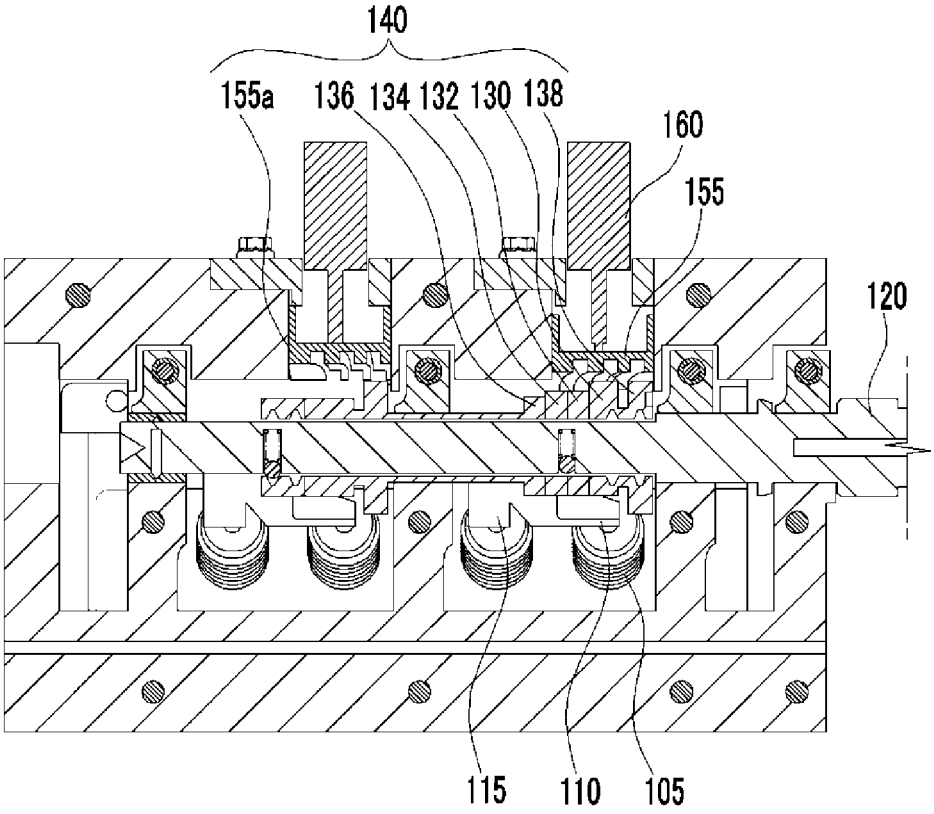
FIG. 6 is a partial sectional top plan view showing that an exemplary variable valve lift apparatus is being operated in a low lift condition according to the present invention.

FIG. 6 is a partial sectional top plan view showing that a variable valve lift apparatus is being operated in a low lift condition according to various embodiments of the present invention.

Referring to FIG. 6, the first roller 117*a* of the rocker arm 115 operates the valve 100 to a low lift mode to correspond to a low cam 136 of the first cam (136, 134, 132, and 130). This is a condition that the first guide 155 moves the cam piece 140 to the right side.

On the contrary, the second guide 155*a* moves the cam piece 140 in a right side in one step. Thus, the valve 100 can be operated in a first middle lift, a second middle lift, and in a high lift.

Figure 7A:
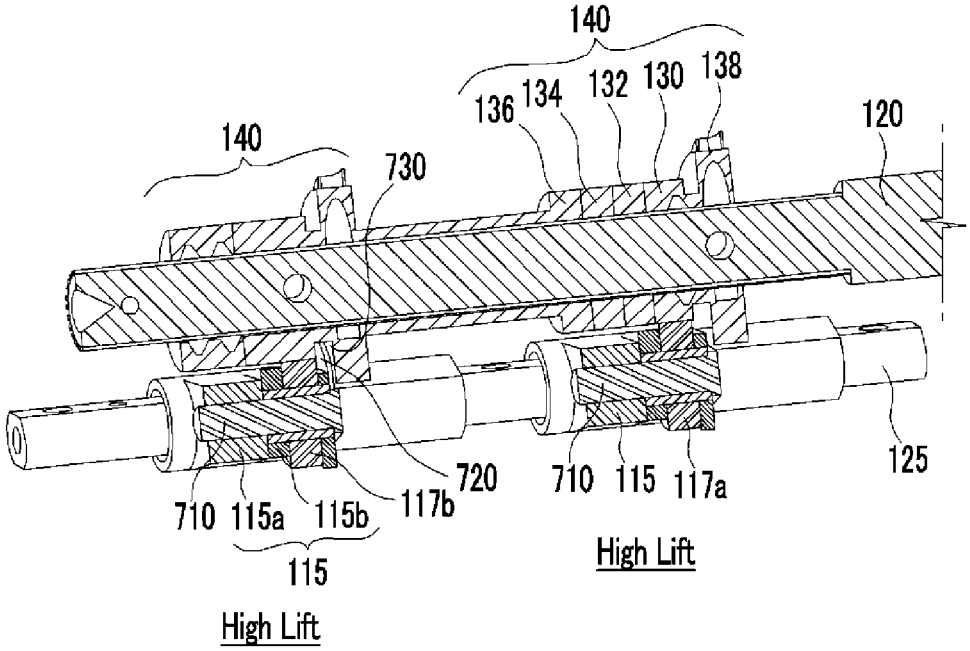
FIG. 7A, 7B and 7C is a partial cross-sectional view of an exemplary variable valve lift apparatus according to the present invention.
Figure 7B:
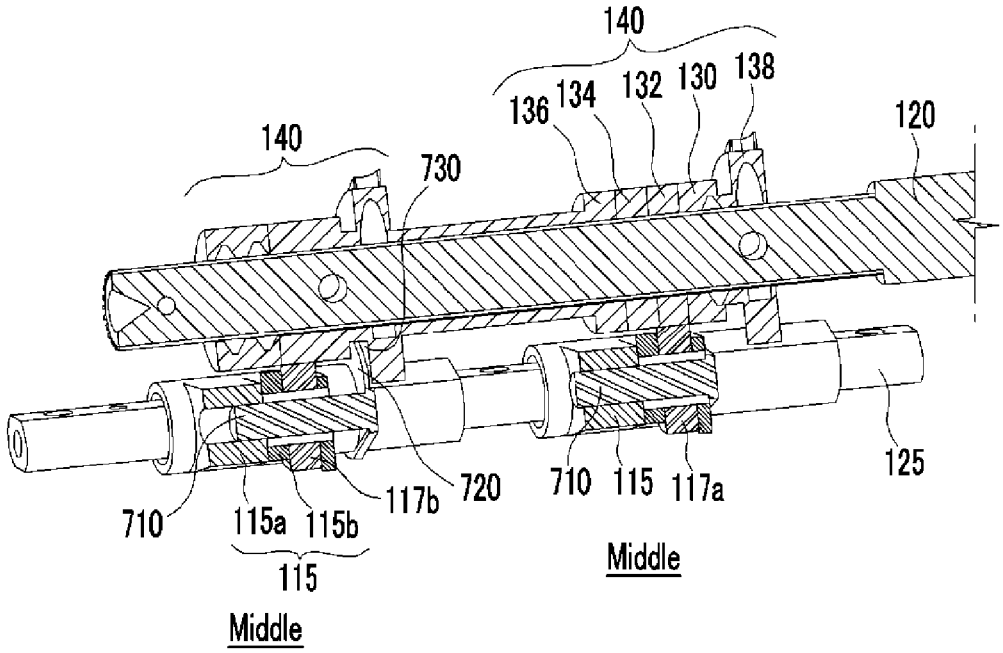
Figure 7C:
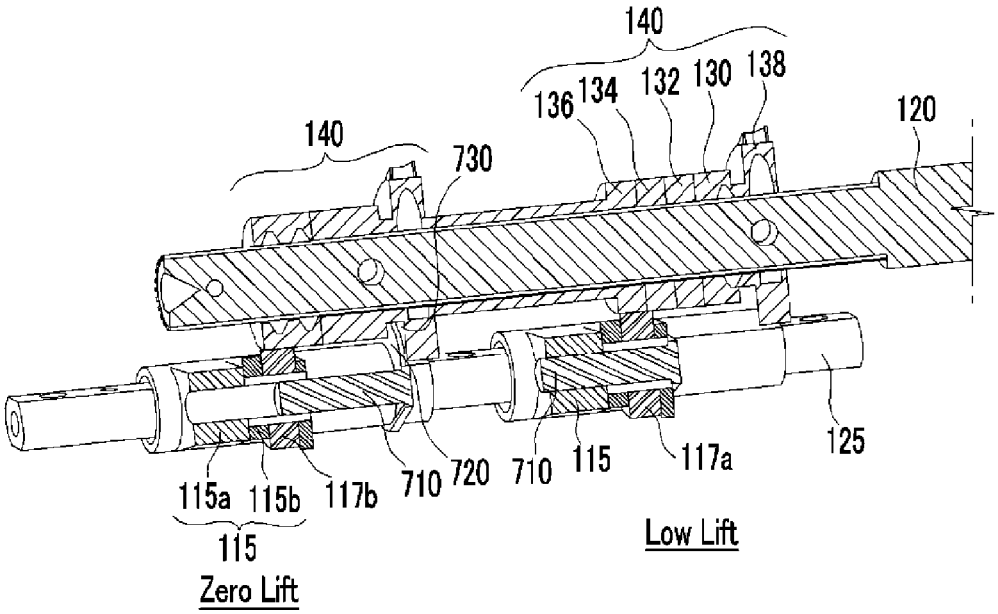

FIG. 7A, 7B and 7C is a partial cross-sectional view of a variable valve lift apparatus according to various embodiments of the present invention.

Referring to FIG. 7A, the cam piece 140 is disposed on the camshaft 120, referring to FIG. 1 and FIG. 7A, the first cams (136, 134, 132, 130) and the first cam protrusion portion 138 are formed at one side of the cam piece 140, and the second cams (136*a*, 134*a*, 132*a*, 130*a*) and the second cam protrusion portion 138*a* are formed at the other side.

As shown in the drawings, the second rocker arm 115*a* and 115*b* that correspond to the second cams (136*a*, 134*a*, 132*a*, 130*a*) lift a valve through the second roller 117*b*, and the first rocker arm 115 that corresponds to the first cams (136, 134, 132, 130) lift the valve 100 through the first roller 117*a*.

The rocker arm shaft 125 penetrates the second rocker arm 115*a* and 115*b*, the second rocker arm 115*a* and 115*b* includes the first member 115*a* and the second member 115*b*, and a latching pin 710 penetrates the first rocker arm 115 and the second rocker arm 115*a* and 115*b*.

The second roller 117*b* is disposed on the second member 115*b*. Accordingly, when one of the second cams (136*a*, 134*a*, 132*a*, 130*a*) presses the second roller 117*b*, the second member 115*b* rotates based on the rocker arm shaft 125.

Further, the second rocker arm 115*a* and 115*b* lifts a valve through a press portion, the latching pin 710 latches the first member 115*a* and the second member 115*b* to move them together.

As shown in the drawings, one side of the latching pin 710 penetrates the first member 115*a* and the second member 115*b* to latch them with each other, and a wing 720 is formed at the other end portion. The wing 720 protrudes in a radial direction of the latching pine 710, and an end portion of the wing 720 is inserted into a latching groove 730 that is formed on the cam piece 140.

Accordingly, the latching pin 710 is moved in accordance with the movement of the cam piece 140. Meanwhile, a wing is not formed on the latching pin 710 that corresponds to the first cams (136, 134, 132, and 130), and a wing 720 is formed on a latching pin 710 that corresponds to the second cams (136*a*, 134*a*, 132*a*, 130*a*).

The first member 115*a* and the second member 115*b* that the latching pin 710 having the wing 720 penetrates can be divided depending on the sliding position of the latching pin 710.

FIG. 7A shows a condition that the cam piece 140 is disposed at the extreme left side, and the latching pin 710 latches the first rocker arm 115 and the second rocker arm 115*a* and 115*b*. And, a valve 100 that corresponds to the first cams (136, 134, 132, 130) and a valve that corresponds to the second cams (136*a*, 134*a*, 132*a*, 130*a*) are operated in a high lift mode.

FIG. 7B shows a condition that the cam piece 140 is moved in one step from the extreme left side to a right side, the latching pine 710 latches the first rocker arm 115 and the second rocker arm 115*a* and 115*b*. And, the valve 100 that corresponds to the first cams (136, 134, 132, and 130) and a valve that corresponds to the second cams (136*a*, 134*a*, 132*a*, and 130*a*) is operated in a middle lift mode.

As described above, the latching pin 710 that corresponds to the first cams (136, 134, 132, 130) does not move, and the latching pin 710 that corresponds to the second cams 136*a*, 134*a*, 132*a*, 130*a*) moves in a right side together with the cam piece 140.

FIG. 7C shows a condition that the cam piece 140 is moved in the extreme right side, the latching pin 710 separates the first member 115*a* from the second member 115*b*. And, the valve 100 that corresponds to the first cams (136, 134, 132, 130) is operated in a low lift mode, and a valve that corresponds to the second cams (136*a*, 134*a*, 132*a*, 130*a*) is not operated in a zero lift mode.

In various embodiments of the present invention, the latching pin 710 can operate the valve in a high lift or a zero lift mode.

Figure 8:
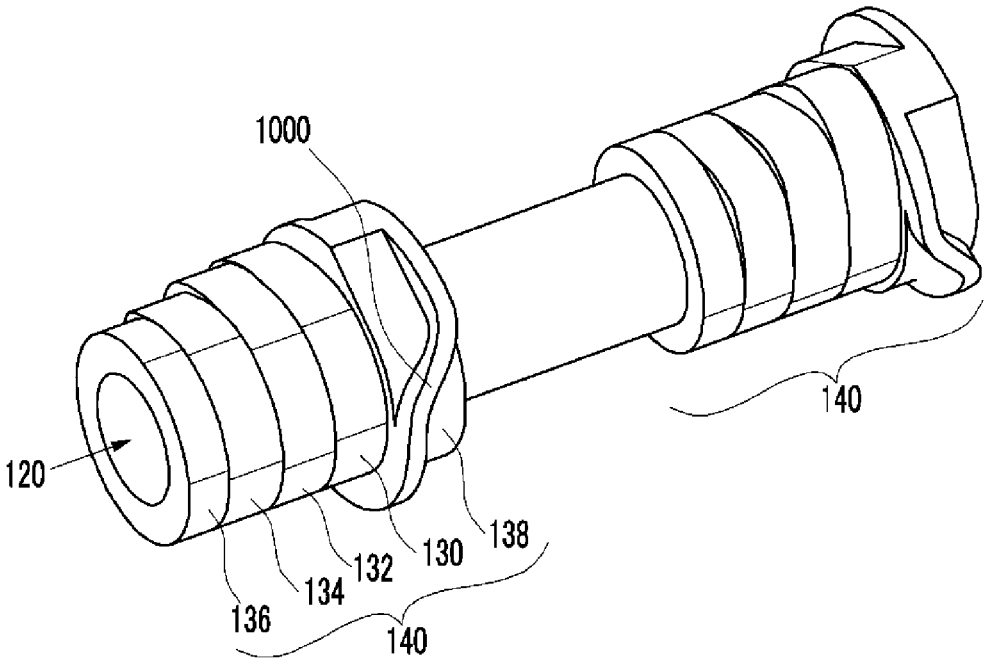
FIG. 8 is a perspective view of a cam piece that is disposed on an exemplary variable valve lift apparatus according to the present invention.

FIG. 8 is a perspective view of a cam piece that is disposed on a variable valve lift apparatus according to various embodiments of the present invention.

Referring to FIG. 8, the first cams (136, 134, 132, 130) are formed on the cam piece 140, the first cam protrusion portion 138 is formed to correspond to the first cams (136, 134, 132, and 130), and a first guide bridge 1000 that is in angled in a length direction of the cam piece 140 or the camshaft 120 is formed on the first cam protrusion portion 138.

Figure 9:
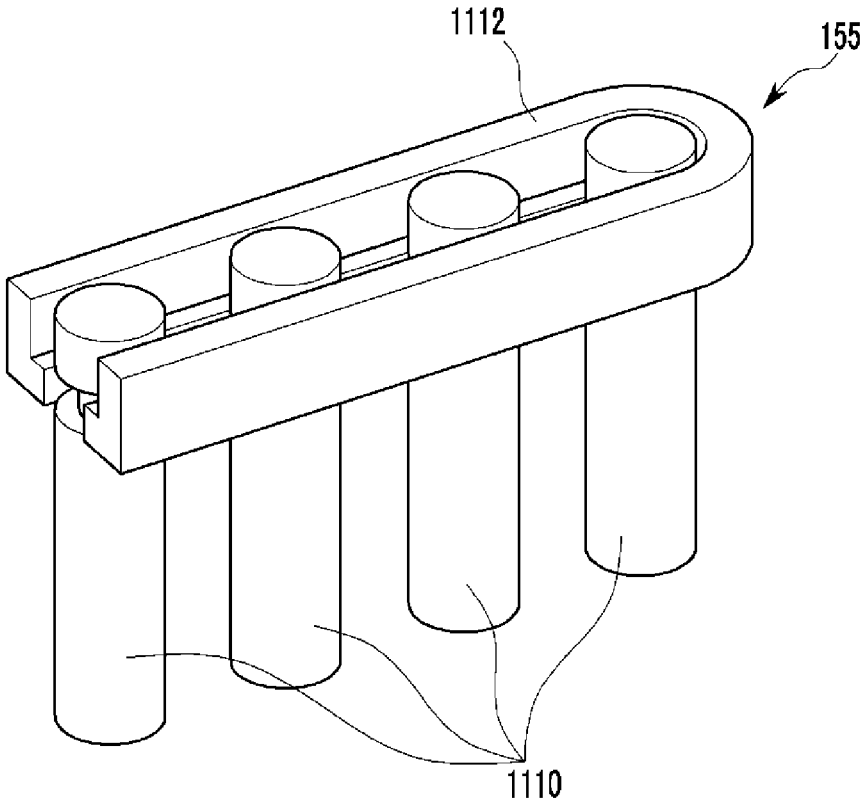
FIG. 9 is a perspective view of a first guide that is disposed on an exemplary variable valve lift apparatus according to the present invention.

FIG. 9 is a perspective view of a first guide that is disposed on a variable valve lift apparatus according to various embodiments of the present invention.

Referring to FIG. 9, the first guide 155 that guides the first guide bridge 1000 of FIG. 8 includes guide shafts 1110 that are arranged with a predetermined gap and a case 1112 that fixes the guide shafts 1110.

If the camshaft 120 and the cam piece 140 rotate in a condition that the first guide bridge 1000 is inserted into the gap between the guide shafts 1110, the cam piece 140 moves along the shape of the first guide bridge 1000 in one side or the other side on the camshaft 120.

If the cam piece 140 rotates in a condition that the first guide bridge 1000 is inserted into the gap between the guide shafts 1110, the return protrusion of the cam protrusion portion 138 pushes the guide shafts 1110 to keep the length direction position of the cam piece 140.

Figure 10:
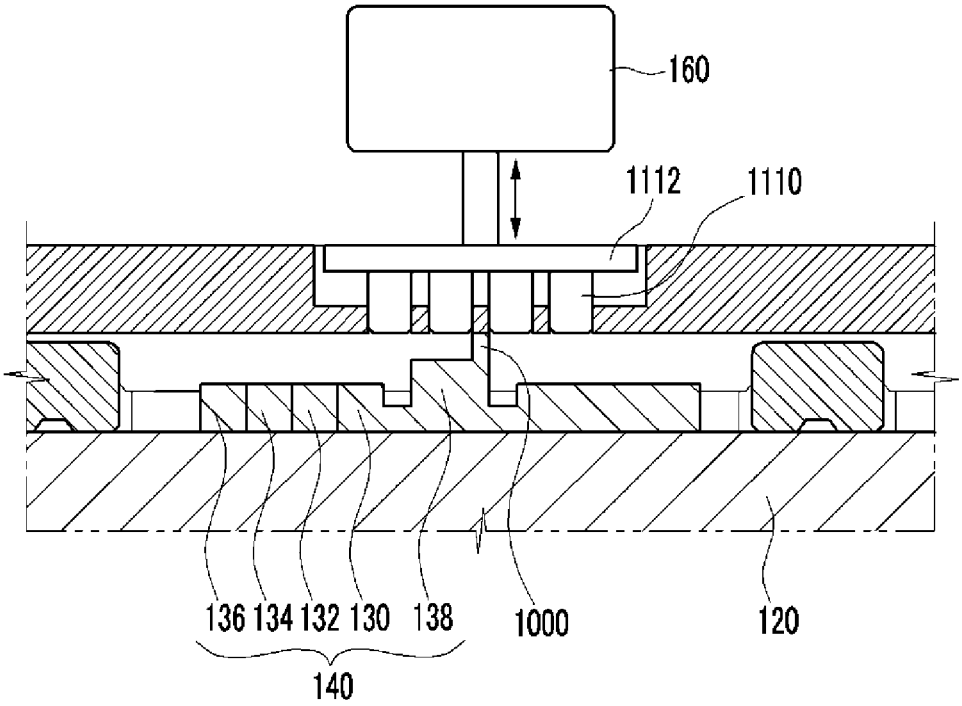
FIG. 10 is a partial cross-sectional view of an exemplary variable valve lift apparatus according to the present invention.

FIG. 10 is a partial cross-sectional view of a variable valve lift apparatus according to various embodiments of the present invention.

Referring to FIG. 10, the cam piece 140 is engaged on the camshaft 120 through a spline, the first guide bridge 1000 is formed on an outside surface of the first cam protrusion portion 138 of the cam piece 140, if the first operating portion 160 pushes the first guide (155, FIG. 9), the first guide bridge is inserted into the gap between the guide shafts 1110 of the first guide 155.

And, if the cam piece 140 continuously rotates together with the camshaft 120, the return protrusion of the cam piece 140 pushes the guide shafts 1110 of the first guide 155 to an original position.

The cam piece 140 has a structure to be moved in a left or a right side according to the shape of the first guide bridge 1000.

The first guide bridge 100 of the cam piece moves the cam piece 140 in one side direction and the second guide bridge moves the cam piece 140 in the other side direction.

For convenience in explanation and accurate definition in the appended claims, the terms left or right, and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable valve lift apparatus, comprising:

a camshaft;

a cam portion including first cams having differing lift amounts formed at one side thereof and a first cam protrusion portion formed adjacent the first cams that is slidably disposed on the camshaft to rotate together with the camshaft;

a first guide pin that protrudes on one side of an exterior circumference of the first cam protrusion portion;

a first guide that is disposed to correspond with the first cam protrusion portion and in which a first guide groove is formed therein to move the first cam portion in one direction along the camshaft according to the rotation of the first guide pin; and a first operation portion that moves the first guide toward the first cam protrusion portion such that the first guide pin is inserted into the first guide groove of the first guide.

2. The variable valve lift apparatus of claim 1, further comprising a first return protrusion that protrudes on an outside surface of the first cam protrusion portion to push forward the first guide such that the first guide pin is separated from the first guide groove.

3. The variable valve lift apparatus of claim 2, wherein the first return protrusion has a structure that becomes more distant from the camshaft in a rotating direction of the first cam protrusion portion.

4. The variable valve lift apparatus of claim 2, wherein the first return protrusion is formed at a predetermined distance from the first guide pin in a rotating direction.

5. The variable valve lift apparatus of claim 1, wherein second cams of differing lift amounts are formed on the first cam portion at a distance from the first cams and a second cam protrusion portion is formed a the second cams, the variable lift apparatus further comprising:

a second guide pin that protrudes on one side of an exterior circumference of the second cam protrusion portion;

a second guide that corresponding with the second cam protrusion portion and in which a second guide groove is formed to guide movement of the second guide pin such that the second cam piece is moved in another side direction along rotation of the camshaft according to rotation of the second guide pin;

a second operating portion that moves the second guide toward the second cam protrusion portion such that the second guide pin is inserted into the second guide groove of the second guide; and a second return protrusion that protrudes from an outside surface of the second cam protrusion portion to push forward the second guide such that the second guide pin is separated from the second guide groove.

6. The variable valve lift apparatus of claim 1, wherein the first cams includes a low cam, a first middle cam that is higher than the low cam, a second middle cam that is higher than the first middle cam, and a high cam that is higher than the second middle cam.

7. The variable valve lift apparatus of claim 2, further comprising a rocker arm that is disposed on the rocker arm shaft so as to lift a valve through the first cam, wherein the rocker arm is disposed adjacent the first member and the first member to press one side of a valve and includes a second member that is disposed to be moved by the first cam, and further comprising a latching pin disposed parallel with the rocker arm shaft, penetrates the first member and the second member and a wing that is inserted into a latching groove of the first cam portion protrudes on one end portion thereof to make the first member and the second member to move together or separate the first member from the second member.

8. The variable valve lift apparatus of claim 2, wherein an inner side width of the first guide groove is longer than the exterior diameter of the first guide pin and a width of the return protrusion is longer than the inner side width of the first guide groove.

9. A variable valve lift apparatus, comprising:

a camshaft;

a cam portion including first cams having differing lift amounts formed at one side thereof and a first cam protrusion portion protruding in an outward direction adjacent the first cams and that is slidably disposed on the camshaft to rotate together with the camshaft;

a first guide bridge that protrudes from the first cam protrusion portion in a rotating direction of the camshaft that is oblique to a length direction of the camshaft;

guide shafts that are disposed to correspond to the first cam protrusion portion, a gap that can be disposed between the guide bridge is formed between them, and moves the first cam portion in one side direction along the camshaft according to the rotation of the first guide bridge; and a first operating portion that moves the first guide toward the first cam protraction portion such that the first guide bridge is inserted into the gap of the guide shafts.

* * * * *